US006010214A

United States Patent [19]

Sago et al.

[11] Patent Number: 6,010,214

[45] Date of Patent: Jan. 4, 2000

[54] INK CARTRIDGE, INK SUPPLYING APPARATUS AND PRINTER

[75] Inventors: Akira Sago, Seto; Tsuneo Yasui, Nagoya; Kazuhiko Matsuda, Kounan; Hakudai Kondo; Masashi Suzuki, both of Nagoya, all of Japan

[73] Assignee: Brother Kogyo Kabushiki Kaisha, Nagoya, Japan

[21] Appl. No.: 09/021,311

[22] Filed: Feb. 10, 1998

[30] Foreign Application Priority Data

Feb. 18, 1997 [JP] Japan ..... 9-033642

[51] Int. Cl.[7] ..... B41J 2/175

[52] U.S. Cl. ..... 347/88; 347/99

[58] Field of Search ..... 347/88, 99

[56] References Cited

U.S. PATENT DOCUMENTS 4,870,430 9/1989 Daggett et al. ..... 347/88

5,030,972 7/1991 Miyazawa et al. ..... 347/88

FOREIGN PATENT DOCUMENTS 0 178 888 4/1986 European Pat. Off. ..... 347/88

*Primary Examiner*—N. Le

*Assistant Examiner*—Shih-Wen Hsieh

*Attorney, Agent, or Firm*—Oliff & Berridge, PLC

[57] ABSTRACT

An ink cartridge retains a plurality of solid inks, each of which is to be heated and dissolved so that the dissolved ink is used for recording record information. The ink cartridge is provided with: a cartridge main body in which the solid inks are aligned and retained; and a plurality of gap members disposed in the cartridge main body for prescribing a gap between each pair of the aligned solid inks adjacent to each other in the cartridge main body.

12 Claims, 8 Drawing Sheets

INK CARTRIDGE, INK SUPPLYING APPARATUS AND PRINTER

BACKGROUND OF THE INVENTION

1. Field of the Invention

The present invention relates to an ink supplying apparatus in a printer for dissolving a solid ink to a liquefied ink and then recording record information by using the liquefied ink.

2. Description of the Related Art

There is a printer for dissolving a solid ink to a liquefied ink and then performing a recording operation by using the liquefied ink. This kind of printer using the solid ink has such a merit that the utilization of the solid ink makes the maintenance easier and that the re-solidification of the ink on a record sheet reduces the bleeding of the ink to thereby perform the recording operation with a high image quality.

The method of actually recording by using the dissolved ink may tar include, for example, a method of using a record head of ink jet type. If using this method, it is possible to obtain the record result with the higher image quality.

In the above mentioned printer, it is typical that, while the record head is moved in a main scan direction of a record sheet, the record sheet is transported to a sub-scan direction to thereby perform the 2-dimensional recording operation. The solid ink is supplied to the record head by dropping the solid ink retained in an ink retainer section into an ink dissolving section disposed at the record head. Then, the recording operation is typically performed such that the supplied solid ink is heated and the thus dissolved ink is thermally maintained so as to keep it in the liquefied state.

In this type of printer, the ink retainer for retaining the solid inks retains the solid inks in a line. Then, they are pushed out from behind, one by one. Further, the pushed out solid inks are dripped below, for example, by using a bar-shaped supply lever, one drop at a time. Accordingly, they are supplied to the ink dissolving section located just under the ink retainer. When retaining the solid inks in a line, the solid inks adjacent to each other are retained in contact with each other.

However, according to the configuration of the ink retainer, the solid inks are in contact with each other, in the condition that they are retained. Thus, when the solid inks are heated by the radiation heat or emission heat from the ink dissolving section, they may be adhered to each other. This results in a problem that the solid inks may not be supplied by the supply lever, one by one.

Moreover, in the above mentioned printer, when supplementing new solid inks for the ink retainer in conjunction with the exhaustion of the solid inks in the ink retainer, a user supplements the solid inks, one by one. Hence, if the consumption amount of the inks are vast, the time it takes to supplement the solid inks becomes long, which results in a problem that the convenience is extremely degraded.

Furthermore, the user may become in direct contact with the solid ink when supplementing it. Thus, for example, when an ambient temperature of the solid ink is raised by a direct sunlight and the like, this results in a problem that the softened solid ink may be adhered to a cloth of the user or the like.

SUMMARY OF THE INVENTION

The present invention is proposed in view of the above mentioned problems. It is therefore an object of the present invention to provide an ink cartridge, an ink supplying apparatus and a printer using them, which can retain solid inks such that the solid inks are not adhered to each other even if the ambient temperature of the solid inks is raised, and can improve the handling convenience of the solid inks.

The above object of the present invention can be achieved by an ink cartridge for retaining a plurality of solid inks, each of which is to be heated and dissolved so that the dissolved ink is used for recording record information. The ink cartridge is provided with: a cartridge main body in which the solid inks are aligned and retained; and a plurality of gap members disposed in the cartridge main body for prescribing a gap between each pair of the aligned solid inks adjacent to each other in the cartridge main body.

According to the ink cartridge of the present invention, the solid inks are aligned and retained in the cartridge main body. At this time, by the gap members disposed in the cartridge main body, a gap is prescribed between each pair of the aligned solid inks adjacent to each other in the cartridge main body. Thus, even if the ambient temperature around the ink cartridge is raised, since the adjacent solid inks are spaced from each other by the gap, the possibility that the adjacent solid inks retained by the ink cartridge are stuck to each other is little or nil. Further, since the solid ink i.e. the ink in a solid state is retained by the ink cartridge, the handling of the ink is rather easy.

Accordingly, the easiness and convenience of handling the ink can be certainly improved in the recording operation by use of the solid ink.

In one aspect of the ink cartridge of the present invention, the cartridge main body has elongated wall members opposed to each other and extending in an alignment direction of the aligned solid inks. And that, the gap members are disposed on both internal surfaces of the elongated wall members and are arranged along the alignment direction.

According to this aspect, the solid inks can be surely and reliably retained by a rather simple construction i.e., by the cartridge main body having the elongated wall members and the gap members disposed on the internal surfaces of the elongated wall members.

In another aspect of the ink cartridge of the present invention, each of the solid inks has a rectangular parallelopiped shape with a necked bottom portion, and the gap members hook each of the solid inks at four corners of the necked bottom portion.

According to this aspect, the solid inks can be surely and reliably retained by a rather simple construction i.e., by the gap members hooking each of the solid inks at four corners of the necked bottom portion.

In another aspect of the ink cartridge of the present invention, the cartridge main body comprises an elastic material such that the solid inks retained therein can be dropped therefrom when the cartridge main body is elastically deformed.

According to this aspect, in case that the solid ink is to be supplied from the ink cartridge, the cartridge main body is elastically deformed by an external force, for example. Then, the solid inks retained in the elastic cartridge main body can be dropped therefrom, so that the solid ink can be promptly and easily supplied therefrom.

The above object of the present invention can be also achieved by an ink supplying apparatus for supplying a plurality of solid inks, each of which is to be heated and dissolved by a heating device so that the dissolved ink is used for recording record information. The ink supplying apparatus is provided with: a storing device for storing a plurality of ink cartridges, each having a cartridge main body in which the solid inks are aligned and retained, and a plurality of gap members disposed in the cartridge main body for prescribing a gap between each pair of the aligned solid inks adjacent to each other in the cartridge main body; a carrying device for carrying the stored ink cartridges either one or several at a time to thereby move the ink cartridge to a supply position at which the solid inks retained by the carried ink cartridge are to be supplied to the heating device; and a supplying device for supplying the solid inks retained by the carried ink cartridge at the supply position to the heating device either one or several at a time.

According to the ink supplying device of the present invention, a plurality of ink cartridges, each of which has the structure same as that of the above described ink cartridge of the present invention are stored by the storing device. Then, the stored ink cartridges are carried by the carrying device either one or several at a time, so that the ink cartridge is moved to the supply position. Then, the solid inks retained by the carried ink cartridge at the supply position is supplied by the supplying device to the heating device either one or several at a time.

Thus, even if the ambient temperature around the ink cartridge is raised, since the adjacent solid inks are spaced from each other by the gap, the possibility that the adjacent solid inks retained by the ink cartridge are stuck to each other is little or nil. Further, since the solid inks can be supplemented just by storing the ink cartridges into the storing device, the handling of the ink is rather easy even in case that the ink consumption amount is large. Furthermore, since the solid ink can be handled without directly touching the solid ink, it is possible to prevent the solid ink from contacting with an external portion such as a hand, a cloth or the like.

Accordingly, the easiness and convenience of handling the ink can be certainly improved in the recording operation by use of the solid ink.

In one aspect of the ink supplying apparatus of the present invention, the storing device piles up and stores the ink cartridges. And that, the carrying device carries the piled and stored ink cartridges to the supplying position, one by one, in an order starting from a bottom thereof. Thus, the structure of the storing device can be simplified and the operation of supplying the solid ink can be easily controlled.

According to this one aspect, the piled up and stored ink cartridges are carried to the supplying position, one by one, in the order starting from the bottom thereof, by the carrying device.

In this one aspect, the carrying device may have a roller device for carrying, in accordance with a rotation thereof, the ink cartridge stored at a lowest portion in the storing device to the supply position. In this case, as the roller device is rotated, the ink cartridge at the lowest portion is carried to the supply position. Accordingly, the structure of the ink supplying device can be certainly simplified.

In this one aspect also, the carrying device may have a belt conveyer device including a belt and a moving section for moving the belt so as to carry the ink cartridge stored at a lowest portion in the storing device to the supply position. In this case, as the belt is moved, the ink cartridge at the lowest portion is carried to the supply position. Thus, the ink cartridge can be transported and the solid ink can be supplied speedily and surely.

In this one aspect also, the carrying device may carry the ink cartridge stored at a lowest portion in the storing device to the supply position by pushing a rear end of the ink cartridge in a carrying direction thereof. In this case, the read end of the ink cartridge is pushed and supplied to the supply position. Thus, the structure of the ink supplying device can be certainly simplified.

In this one aspect also, the ink cartridge may retain the solid inks aligned in one line along a carrying direction of the ink cartridge. And that, the supplying device may supply the solid inks retained by the carried ink cartridge to the heating device, one by one. In this case, the solid inks aligned along the carrying direction can be supplied one by one along the carrying direction. Thus, the structure of the ink supplying device can be certainly simplified and the operation of supplying the ink can be easily controlled.

The above object of the present invention can be also achieved by a printer provided with: the aforementioned supplying apparatus for supplying the solid inks of the present invention; a heating device for heating and dissolving each of the supplied solid inks; and a recording device for recording record information by use of the dissolved ink.

According to the printer of the present invention, the solid inks are supplied by the aforementioned supplying apparatus of the present invention. Then, each of the supplied solid inks are heated and dissolved by the heating device. Finally, the record information is recorded by use of the dissolved ink, by the recording device.

Accordingly, the handling of the solid ink is rather easy in the printer. Further, even if the recording operation in which the ink consumption amount is large is performed, the handling for the printer can be still made easy by reducing the number of times for supplementing the solid inks.

In one aspect of the printer of the present invention, the recording device records the record information by means of an ink jet method.

According to this aspect, the handling of the inks in the printer is easy and the clean recording result can be obtained by the printer.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

Preferred embodiments for the present invention are explained with reference to the drawings. An embodiment described below is an embodiment in which the present invention is applied to a printer for dissolving a solid ink to a liquefied state and then performing a recording operation by an ink jet method using the liquefied ink.

(I) Configuration And Operation Of Main Portion

Figure 1:
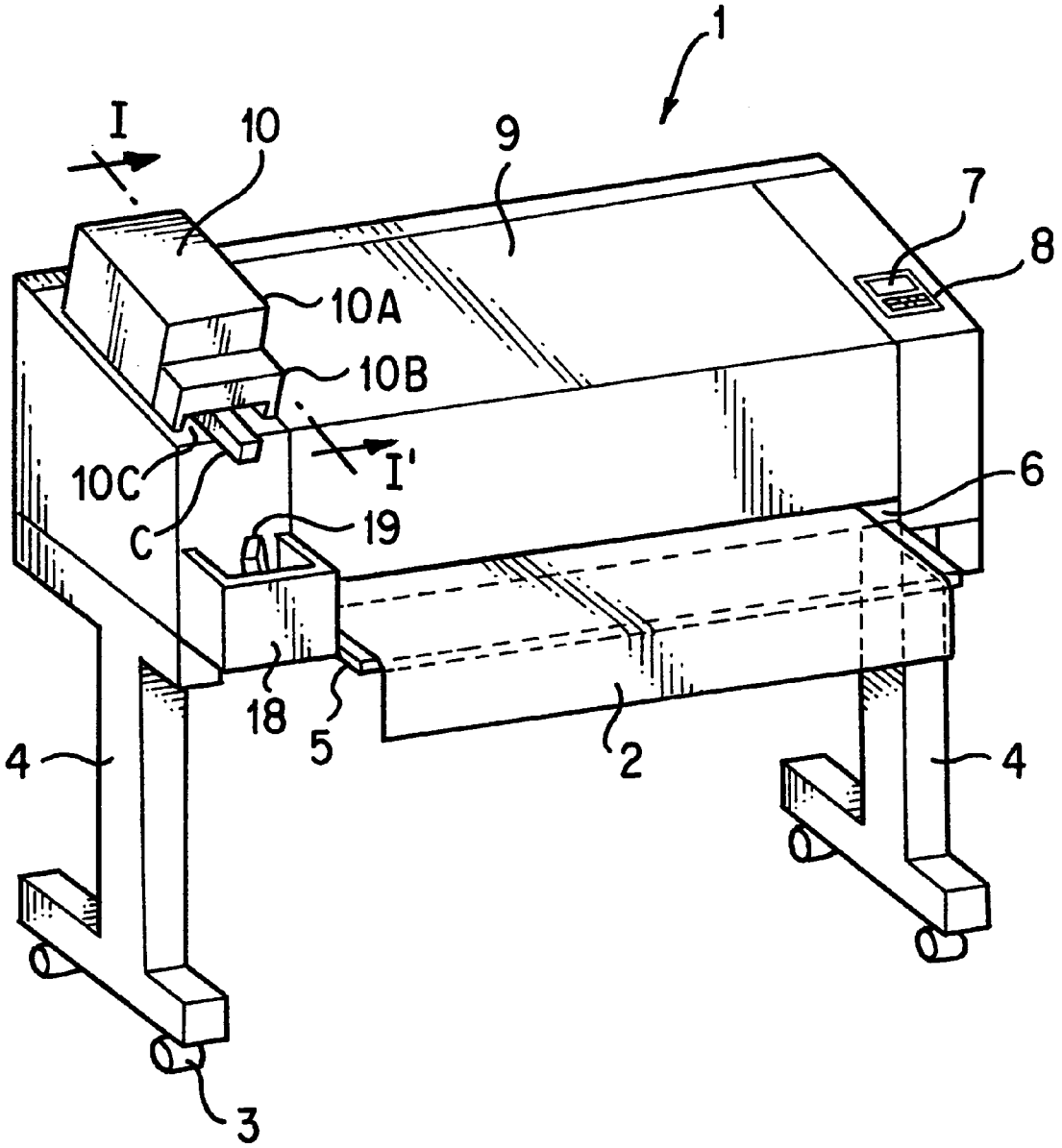
FIG. 1 is a perspective view showing an appearance of a printer as an embodiment of the present invention.
Figure 2:
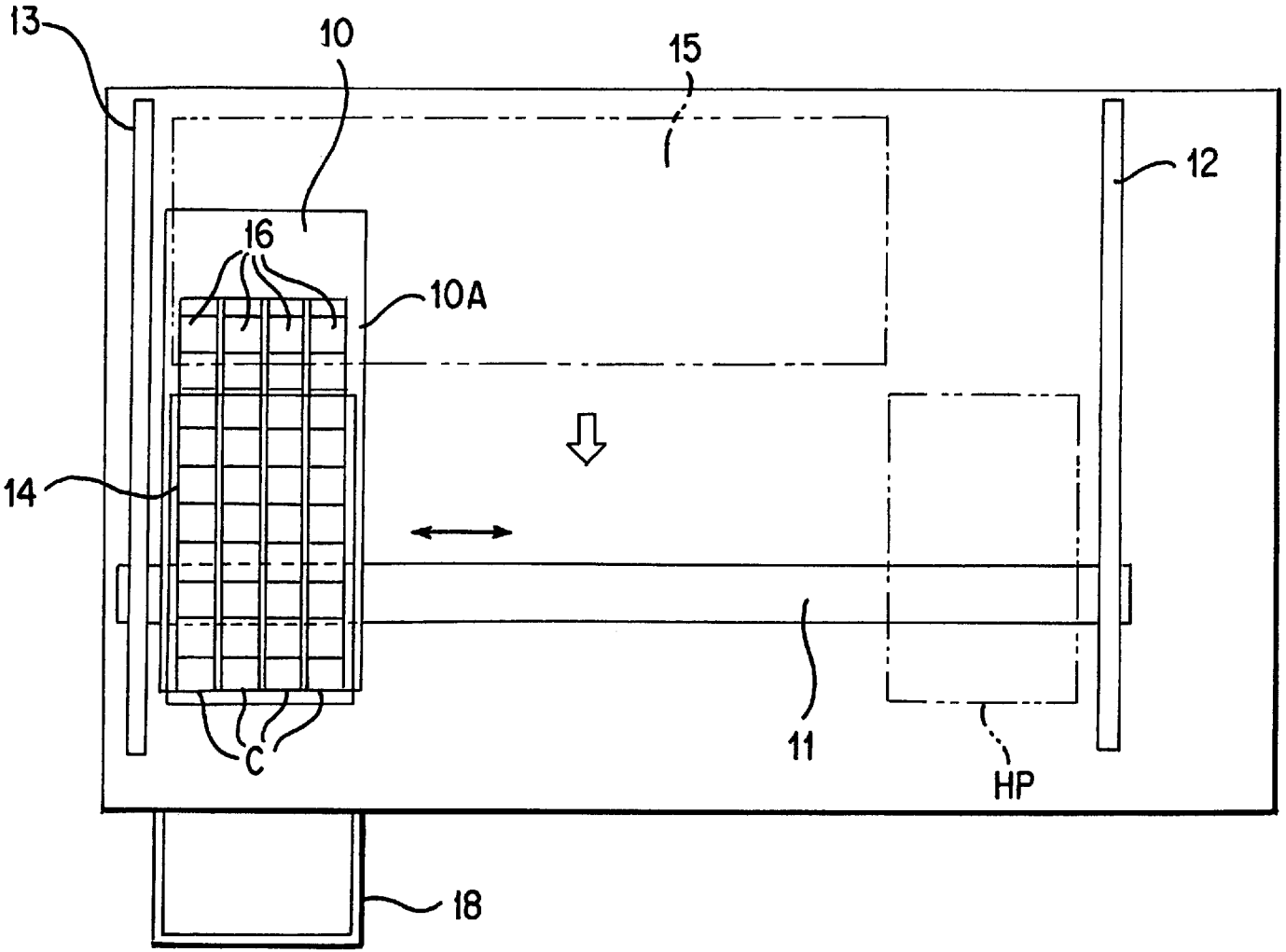
FIG. 2 is a plan view showing an inside of the printer in the embodiment.
Figure 3:
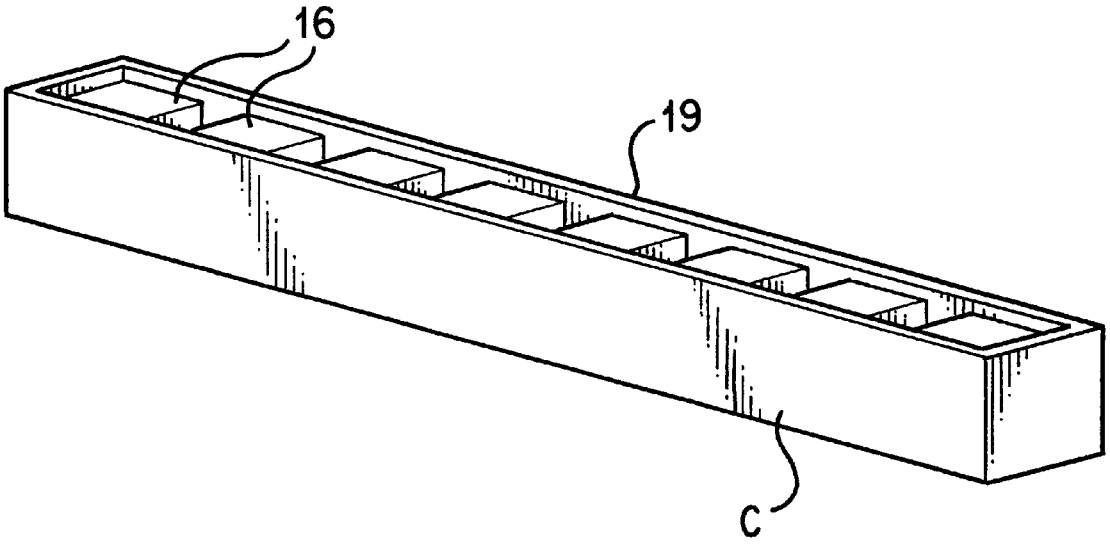
FIG. 3 is a perspective view showing an appearance of an ink cartridge of the printer in the embodiment.
Figure 4A:
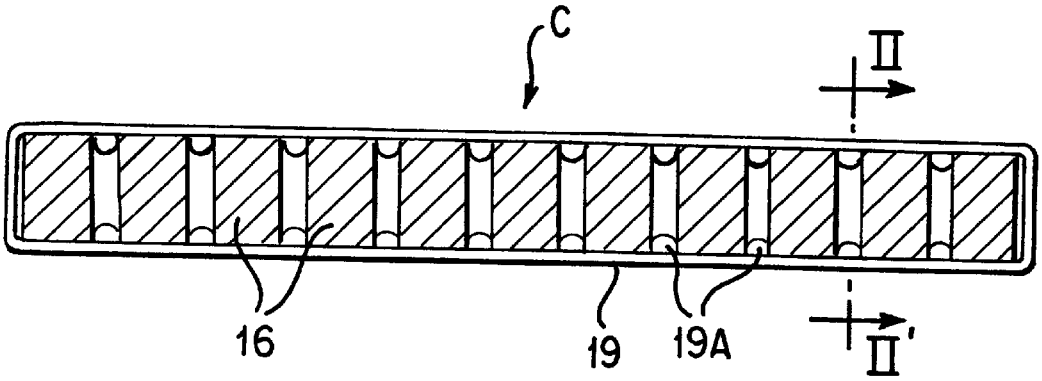
FIG. 4A is a plan view of an ink cartridge in the embodiment.
Figure 4B:
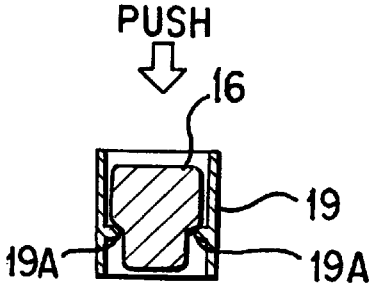
FIG. 4B is a II—II section view of FIG. 4A.
Figure 4C:
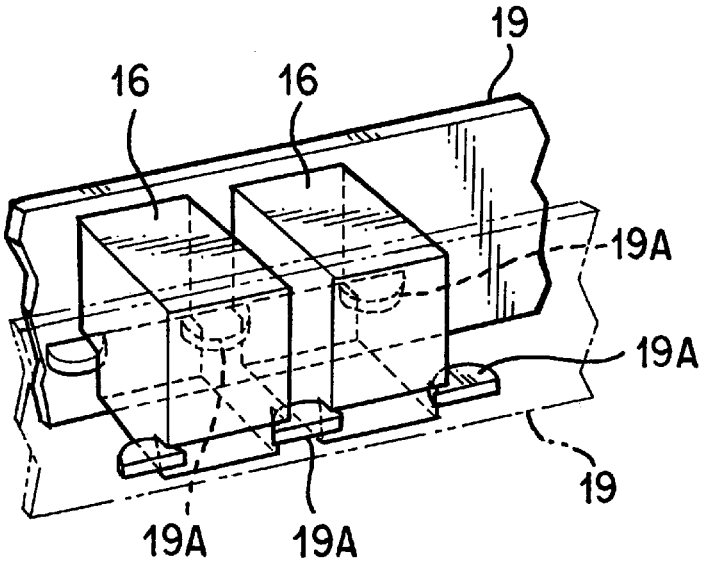
FIG. 4C is a perspective view of the ink cartridge retaining solid inks in the embodiment.
Figure 5:
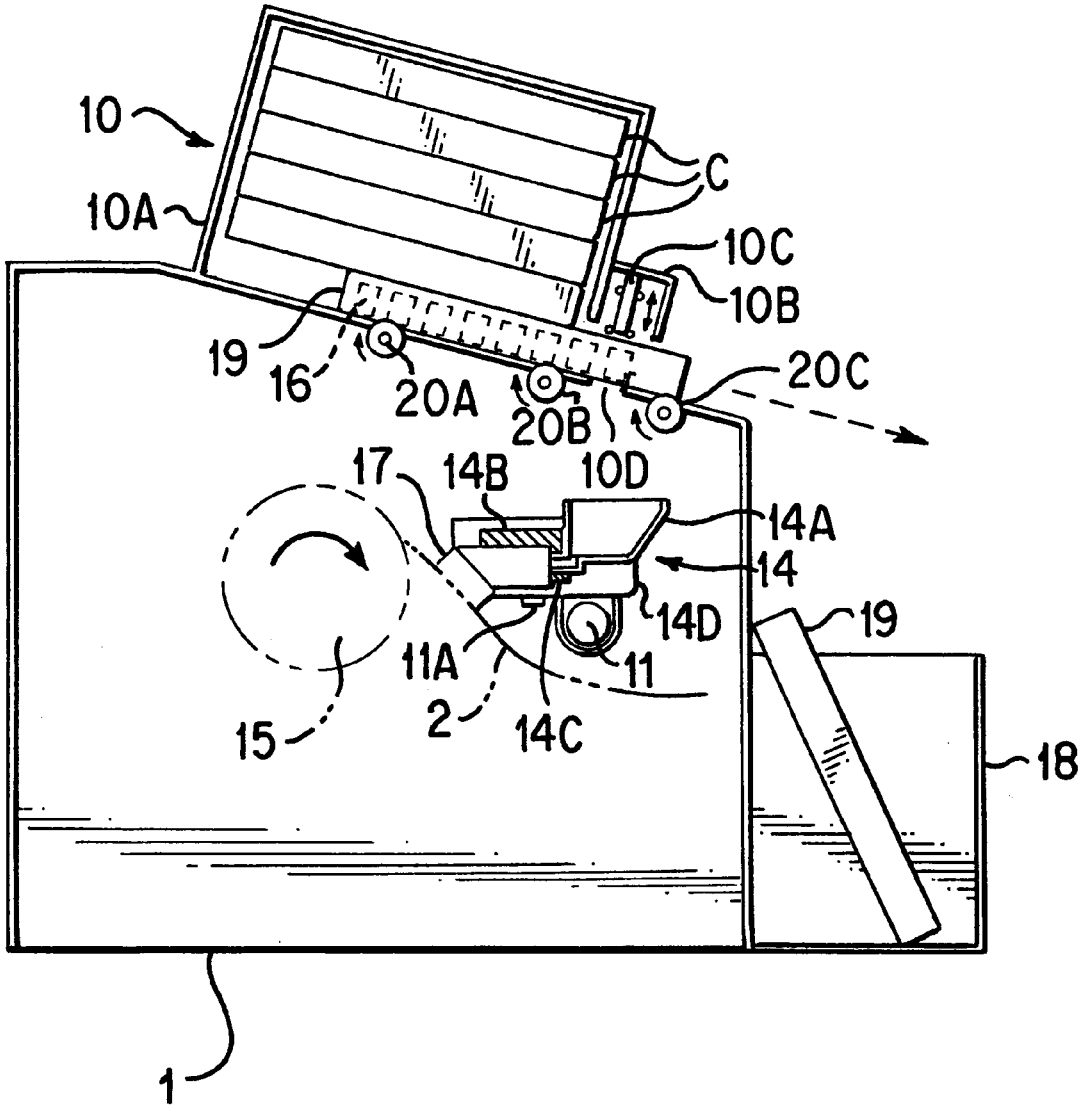
FIG. 5 is a section view showing the inside of the printer in the embodiment.
Figure 6:
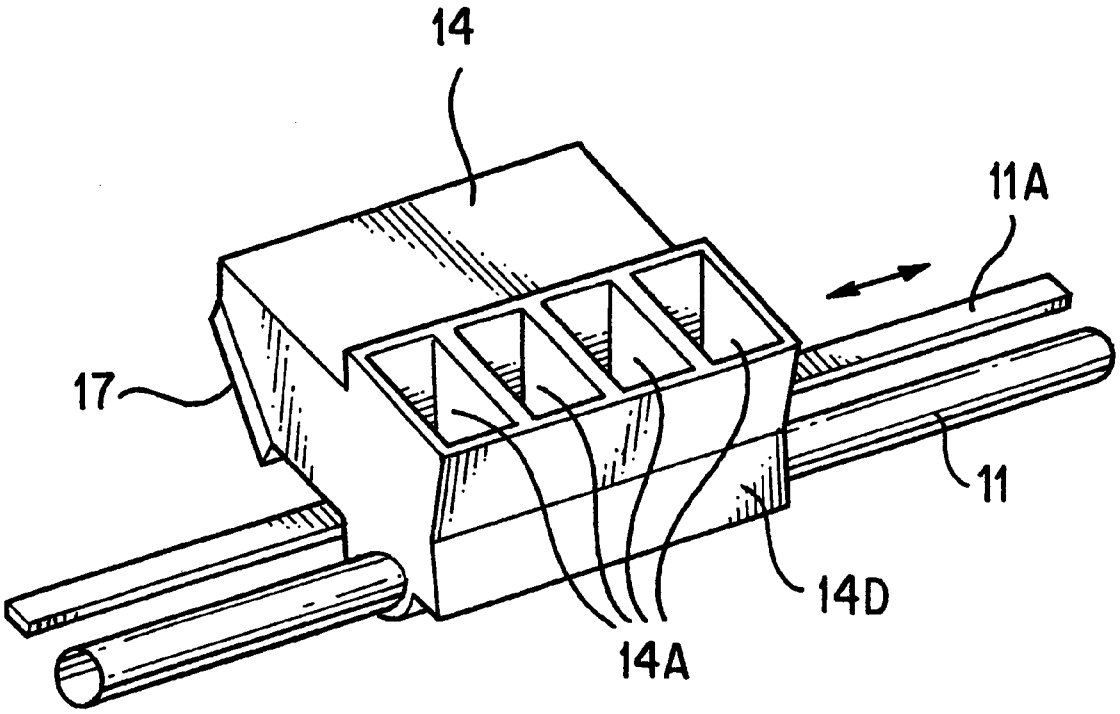
FIG. 6 is a perspective view showing a portion in relation to a driving mechanism of a carriage of the printer in the embodiment.

At first, a configuration of a printer according to the embodiment and operations of a main portion thereof are explained with reference to FIGS. 1 to 6. FIG. 1 is a perspective view showing the appearance of the printer according to the embodiment, FIG. 2 is a plan view showing an inner configuration when a cover 9 described later is removed, FIG. 3 is a whole perspective view of an ink cartridge of the present invention, FIG. 4A is a plan view of the ink cartridge, FIG. 4B is a section view of the ink cartridge, FIG. 4C is a perspective view of the ink cartridge, FIG. 5 is a I—I section view of FIG. 1, and FIG. 6 is a perspective view showing an appearance of a carriage 14 described later.

As shown in FIG. 1, a printer 1 of the embodiment is constructed so as to print and output a record sheet 2 having a size equal to or more than an A0 size. A pair of legs 4 having casters 3 are disposed at the bottom of the printer 1. A record sheet discharge port 6 from which the record sheet 2 is discharged and a discharge tray 5 for retaining the discharged record sheet 2 are disposed at the front side of the printer 1. A cover 9 which can be opened and closed so as to perform an inner maintenance and the like, a display 7 for displaying various states and an operating section 8 for performing predetermined operations are disposed at the top side of the printer 1.

Moreover, a controller composed of a micro computer (not shown) for controlling the whole printer 1 and the like is mounted inside the operating section 8.

On the other hand, an ink supplying section 10 according to the present invention is disposed on the side opposite to the operating section 8 at the top surface of the printer. The ink supplying section 10 is provided with a storing section 10A servicing as one example of a storing device for storing a plurality of ink cartridges C described later to retain solid inks, and a supplying section 10B servicing as one example of a supplying device for supplying the solid inks to a carriage 14 described later. A receiving section 18 for holding the discharged ink cartridge C is disposed at the bottom of a discharge port 10C, which is disposed at the supplying section 10B and discharges the used ink cartridge C.

As shown in FIG. 2, inside the storing section 10A, in order to perform the colorably recording operation, for example, the solid inks 16 for each of four colors of cyan, magenta, yellow and black are retained in a line within the ink cartridge C respectively. The ink cartridges C are stored by piling up a plurality of ink cartridges C corresponding to the same color.

Next, the inner configuration of the printer 1 is explained with reference to FIG. 2.

As shown in FIG. 2, the carriage 14 servicing as one example of a recording device for actually performing the recording operation by using the ink jet type performs the recording operation while moving in the left and right directions of FIG. 2 (a main scan direction of the record sheet 2) on a guide 11 bridged between frames 12 and 13 disposed on both sides of the printer 1. At this time, since the record sheet 2 stored as a roll 15 is transported out in a front direction (a sub-scan direction) of FIG. 2, the recording operation on the record sheet 2 is performed in conjunction with the operation of the carriage 14.

At this time, when the carriage 14 is to receive the solid ink 16 from the ink supplying section 10, the carriage 14 is moved just under the ink supplying section 10 (the position of the carriage 14 shown by a solid line in FIG. 2) and then receives the solid ink 16.

Here, the ink cartridge C according to the present invention to retain the solid inks 16 used for the recording operation is explained with reference to FIGS. 3 and 4.

As shown in FIG.3, the ink cartridge C according to the present invention retains in a line a plurality of solid inks 16 (eight solid inks 16, in a case of FIG. 3) by using a flexible case 19 made of resin and the like. At this time, there is a gap of a predetermined length between each pair of the solid inks 16 adjacent to each other.

Here, the ink cartridge C is explained in more detail with reference to FIGS. 4A to 4C. Namely, as shown in FIG. 4A, a plurality of sets of protrusions 19A (having a set number corresponding to the number of the stored solid inks 16 in the case 19) servicing as one example of a gap generating member are formed inside the case 19 of the ink cartridge C, in such a way that the protrusions 19A are located opposite to each other on inner wall surfaces of the case 19, and that there are spaces (gaps) between the respective adjacent solid inks 16 when the solid inks 16 are retained in the case 19. Since each solid ink 16 is inserted between the protrusions 19A, the gap is generated between the adjacent solid inks 16 when the solid inks 16 are retained in the case 19.

As shown in FIG. 4B (i.e. the B–B' section view of FIG. 4A), the protrusion 19A also has a function of retaining the solid inks 16 by hooking the solid inks 16. That is, as actually shown in FIG.4C, the solid inks 16 are stored in the case 19 such that four corners of each of the solid inks 16 are respectively supported by the protrusions 19A. The lower half of each of the solid inks 16 is slightly necked, and further the tip of the protrusion 19A is inserted between the solid inks 16 adjacent to each other. Hence, the solid inks 16 are retained within the case 19 without the possibility that the solid inks 16 adjacent to each other are contacted and adhered to each other.

When the retained solid ink 16 is supplied to the carriage 14, it is pushed out from the top of the ink cartridge C (from a direction shown by an arrow of FIG. 4B), and is accordingly dropped below the ink cartridge C, so as to be supplied to the carriage 14. At this time, the solid ink 16 is dropped below such that the case 19 is deformed to spread in the left and right directions of FIG.4B.

Next, the configuration of the printer 1 is further explained.

As shown in FIG. 5, the ink supplying section 10 has the storing section 10A for piling up and storing a plurality of ink cartridges C, each of which retains the solid inks 16 having the same color. Carrying rollers 20A, 20B and 20C servicing as one example of a carrying device for moving the ink cartridge C stored in the lowest portion to a position under the supplying section 10B are disposed at the bottom of the storing section 10A. These carrying rollers 20A, 20B and 20C are controlled so as to be rotated, in synchronization with each other, in the solid arrow directions of FIG. 5. The ink cartridge C is intermittently carried in the direction to the supplying section 10B (i.e., the direction shown by the dotted arrow of FIG. 5) by a distance corresponding to one solid ink 16.

The supply lever 10C is disposed within the supplying section 10B into which the ink cartridge C retaining the solid ink 16 is carried. The solid ink 16 retained within the carried ink cartridge C is passed through a hole 10D by the upward and downward linear motion of the supply lever 10C as shown in FIG. 5, and the solid ink 16 is dropped into the later described ink dissolving section 14A of the carriage 14. At this time, the ink cartridge C is carried in the right direction of FIG. 5 by a distance corresponding to one solid ink 16 when one solid ink 16 is dropped, and then a next solid ink 16 is positioned just under the supply lever 10C.

After all the solid inks 16 within one ink cartridge C are supplied to the carriage 14, only the empty case 19 is further carried, and finally dropped into the receiving section 18. Then, a next ink cartridge C stored in the storing section 10A is moved downward, and is positioned on the carrying rollers 20A and 20B, so as to be nextly carried.

The empty case 19 held in the receiving section 18 can be re-used. Thus, it is possible to fill the case 19 collected in the receiving section 18 with a new solid ink 16 to thereby construct a new ink cartridge C. At this time, it is desirable to construct the receiving section 18 so as to hold the cases 19 separately for the respective colors of the solid inks 16.

When the cases 19 are not re-used, it is also possible to hold the cases 19 in the receiving section 18 without the discrimination for each color, so as to dump them as they are.

As in the side view shown in FIG. 5, the carriage 14 is provided with: a record head 17 for actually recording the record information onto the record sheet 2 by using the ink jet method; the ink dissolving section 14A servicing as one example of a heating device for heating and accordingly dissolving the solid ink 16 supplied by the supplying section 10B to thereby supply the dissolved ink to the record head 17; an ink tank 14D for transiently holding the supplied liquefied ink while thermally maintaining it; a heater 14B for liquefying the solid ink 16 into the liquefied ink and maintaining the liquefied state of the liquefied ink by heating the ink dissolving section 14A; and an ink remaining amount sensor 14C for detecting a remaining amount of the liquefied ink. A direct current which is easy to perform a regular control is applied to the heater 14B among them. An alternative current may be utilized as the heater 14B instead.

FIGS. 2 and 5 show a situation that the carriage 14 is located just under the ink supplying section 10, and that the solid ink 16 is supplied from the supplying section 10B to the carriage 14.

Moreover, the supplying section 10B and the carrying rollers 20A, 20B and 20C are provided for each color. Four sets of those supplying section 10, and the carrying rollers 20A, 20B and 20C for cyan, magenta, yellow and black are provided in the present invention.

On the other hand, corresponding to this, the carriage 14 is provided with four ink dissolving sections 14A for each color, as in the perspective view shown in FIG.6. A timing belt 11A moved by a motor (not shown) is fixed on the carriage 14. While the carriage 14 is supported on the guide 11, the carriage 14 is moved in a main scan direction (shown by both arrows in FIGS. 2 and 6) by the timing belt 11A. Accordingly, the recording operation is performed for each color.

Moreover, the carriage 14 is controlled to be located at a home position HP (a position which is beyond a transport route of the record sheet 2 i.e. out side of a printing range of the recording head 17, and is located in the vicinity of the frame 12) shown in FIG. 2, in the waiting state in which the actual recording operation is not performed (but the liquefied state of the liquefied ink is maintained by keeping the temperature thereof at a predetermined temperature so as to promptly restart the actual recording operation).

(II) Operation Of Ink Supplying Section

Next, operations of the ink supplying section 10 are further explained with reference to FIGS. 5, 7A and 7B. Incidentally, operations explained below are generally controlled by the controller in the printer 1.

Figure 7A:
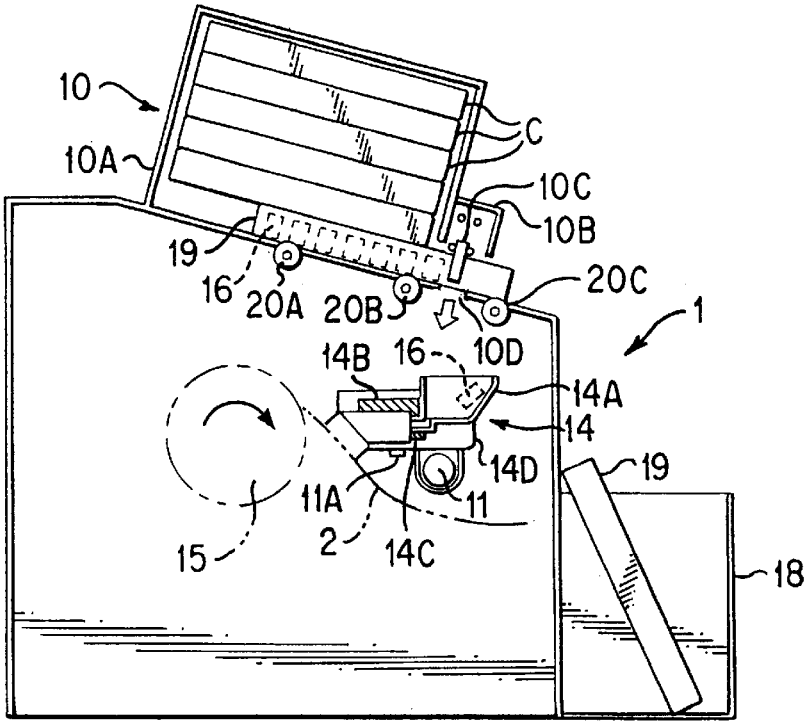
FIG. 7A is a section view showing a situation when the solid ink is supplied to the carriage, in the operations of an ink supplying section in the embodiment.
Figure 7B:
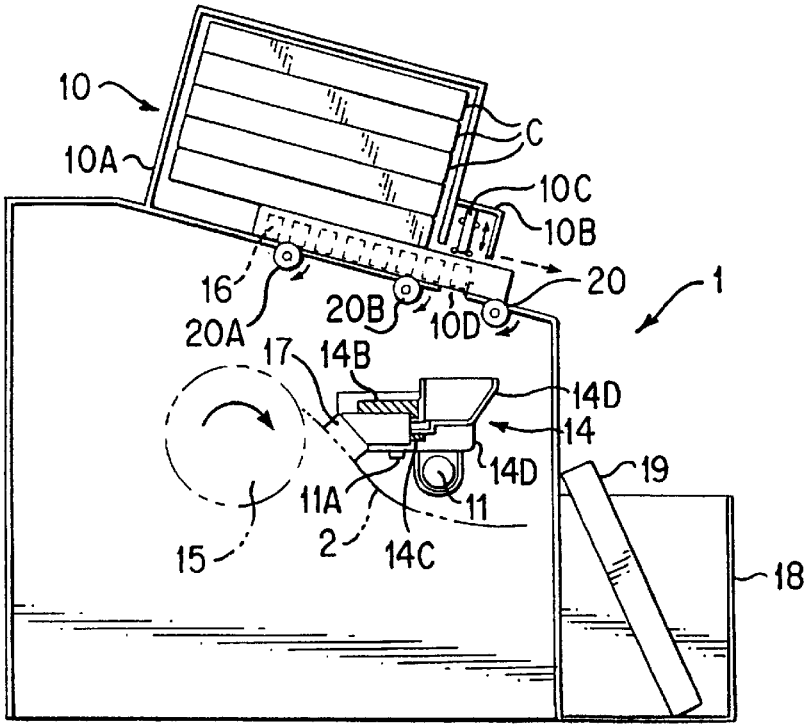
FIG. 7B is a section view showing a situation when the ink cartridge is carried, in the operations of the ink supplying section in the embodiment.

In FIGS. 5, 7A, and 7B, when the solid ink 16 is to be supplied to the carriage 14, the carriage 14 is firstly moved just under the ink supplying section 10.

At this time, the ink cartridge C is carried by the rotations of the carrying rollers 20A and 20B such that the solid ink 16 to be supplied is positioned just under the supply lever 10C.

When the solid ink 16 to be supplied is positioned just under the supply lever 10C, next, the supply lever 10C is moved downward, as shown in FIG. 7A. Accordingly, the solid ink 16 is pushed out, is passed through the hole 10D, and is dropped into the ink dissolving section 14A, so that it is supplied to the ink dissolving section 14A. At this time, the deformation of the case 19 in the ink cartridge C causes the solid ink 16 to be passed through the protrusion 19A within the case 19 to be dropped.

Then, when the solid ink 16 has been supplied, next, as shown in FIG. 7B, the supply lever 10C is moved upward, and further the ink cartridge C is carried by a distance corresponding to one solid ink 16 by the rotations of the carrying rollers 20A, 20B and 20C, and thereby a next solid ink 16 is positioned just under the supply lever 10C.

The operations shown in FIGS. 5, 7A and 7B are controlled independently for each color.

After the solid ink 16 has been supplied to the ink dissolving section 14A, the solid ink 16 is heated and dissolved in the ink dissolving section 14A. Then, the recording operation is executed by the ink jet method by using the liquefied ink.

The recording operation for the record information is continuously executed by the repetition of the above explained operations.

Incidentally, the supplement of the solid ink 16 in conjunction with the exhaustion of the solid ink in the ink storing section 10A is performed by supplementing the plurality of ink cartridges C into the storing section 10A for each of the ink cartridges C.

As explained above, according to the operations of the printer 1 including the ink supplying section 10 of the embodiment, there is the gap between each of the adjacent solid inks 16 (adjacent to each other) by the protrusions 19A formed inside the ink cartridge C. Thus, even if the ambient temperature of the ink cartridge C is raised, the adjacent solid inks 16 are not adhered to each other, in the condition that the solid inks 16 are retained in the ink cartridge C.

Further, since the solid ink 16 is retained within the ink cartridge C, the handling of the solid ink 16 is easy.

Furthermore, since the solid ink 16 can be supplemented only by storing the ink cartridge C into the storing section 10A, the handling of the printer 1 is easy even if the ink consumption amount is vast.

Since the solid ink 16 can be handled without the direct contact with the solid ink 16, the ink is never adhered to an external portion.

The plurality of ink cartridges C are piled up and stored in the storing section 10A. Further, the carrying rollers 20A, 20B and 20C carry the piled and stored ink cartridges C to the position of the supplying section 10B, one by one, at the order starting from the bottom. Thus, it is possible to make the configuration of the ink supplying section 10 simpler, and it is also possible to make the control of the supplying operation easier.

Furthermore, since the carriage 14 records the record information by using the ink jet method, it is possible to simplify the handling in the printer 1, and it is also possible to obtain the clean record result.

(III) Modified Embodiments

Figure 8A:
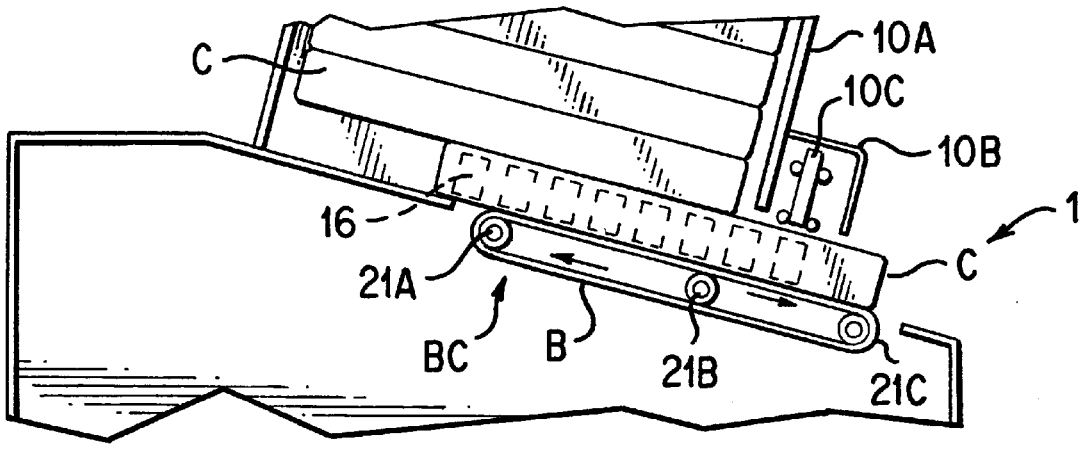
FIG. 8A is a section view of an ink supplying section in one modified embodiment.
Figure 8B:
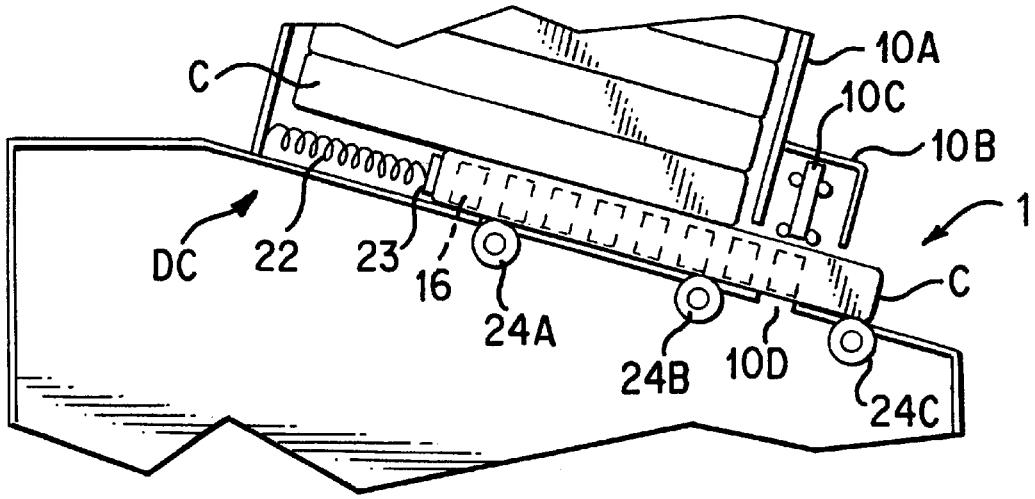
FIG. 8B is a section view of an ink supplying section in another modified embodiment.

Next, the modified embodiments according to the present invention are explained with reference to FIGS. 8A and 8B. FIGS. 8A and 8B are enlarged views with regard to the carrying mechanism of the ink cartridge C in the printer 1.

At first, as a first modified embodiment, as shown in FIG. 8A, the carrying mechanism of the ink cartridge C may be constituted by a belt conveyer section BC servicing as one example of a belt conveyer device provided with a driving roller 21A, rollers 21B and 21C servicing as a moving section and a belt B bridged between the driving roller 21A and the roller 21C. In this case, the carrying operation is controlled by rotating the driving roller 21A under the control of the controller.

According to the configuration of carrying the ink cartridge C by using this belt conveyer section BC, it is possible to quickly and surely carry the ink cartridge C to thereby supply the solid ink 16.

Moreover, as a second modified embodiment, as shown in FIG. 8B, rollers 24A, 24B and 24C are constructed as freely rotatable rollers. Then, the ink cartridge C may be pushed out to be carried by a pushing section DC, which is provided with a spring 22 and a pushing plate 23, from the rear of the ink cartridge C in the carrying direction. At this time, it is necessary to control the carrying amount of the ink cartridges C by disposing a stopper and the like such that the ink cartridge C is stopped just under the supply lever 10C for each solid ink 16.

According to the configuration of carrying the ink cartridge C by using this pushing section DC, it is possible to further simplify the configuration of the ink supplying section 10.

Incidentally, in each of the above mentioned embodiments and modified embodiments, the configuration has been explained in which the solid ink 16 is directly supplied from the supplying section 1OB to the ink dissolving section 14A and then the liquefied ink is generated in the ink dissolving section 14A. However, the present invention is not limited to this configuration. For example, the present invention may be applied to a printer having a configuration described below. That is, an intermediate tank for heating the solid ink 16 is disposed between the supplying section 10B and the ink dissolving section 14A. While the solid ink 16 is transiently retained in the intermediate tank, it is heated and accordingly softened or liquefied therein. After that, it is supplied to the ink dissolving section 14A. According to the configuration having this intermediate tank, the time until the solid ink becomes liquefied after it is supplied to the carriage 14 is short or almost zero. Hence, even if the liquefied ink retained by the carriage 14 (i.e., the side of ink tank 14D) becomes little, it is possible to quickly supplement the solid ink to the ink dissolving section 14A to thereby continue the recording operation without intermittence.

Moreover, in each of the above mentioned embodiments and modified embodiments, the case has been explained in which the recording operation is performed for the record sheet 2 retained in a form of a roll 15. However, the present invention is not limited thereto. For example, the present invention may be applied to a case in which the recording operation is performed for a so-called cut-form sheet which is cut in a predetermined size.

Furthermore, in each of the above mentioned embodiments and modified embodiments, the case has been explained in which the present invention is applied to the printer for performing the recording operation by using the ink jet method. However, the present invention is not limited thereto. For example, the present invention can be widely applied to a printer for retaining the solid ink and further dissolving it to thereby perform the recording operation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An ink cartridge for retaining a plurality of solid inks, each of which is to be heated and dissolved so that the dissolved ink is used for recording record information, said ink cartridge comprising:

a cartridge main body in which the solid inks are aligned and retained; and a plurality of gap members disposed in said cartridge main body for prescribing a gap between each pair of the aligned solid inks adjacent to each other in said cartridge main body.

2. An ink cartridge according to claim 1, wherein said cartridge main body comprises elongated wall members opposed to each other and extending in an alignment direction of the aligned solid inks, and said gap members are disposed on both internal surfaces of said elongated wall members and are arranged along the alignment direction.

3. An ink cartridge according to claim 1, wherein each of the solid inks has a rectangular parallelopiped shape with a necked bottom portion, and said gap members hook each of the solid inks at four corners of the necked bottom portion.

4. An ink cartridge according to claim 1, wherein said cartridge main body comprises an elastic material such that the solid inks retained therein can be dropped therefrom when said cartridge main body is elastically deformed.

5. An ink supplying apparatus for supplying a plurality of solid inks, each of which is to be heated and dissolved by a heating device so that the dissolved ink is used for recording record information, said ink supplying apparatus comprising:

a storing device for storing a plurality of ink cartridges, each comprising a cartridge main body in which the solid inks are aligned and retained, and a plurality of gap members disposed in said cartridge main body for prescribing a gap between each pair of the aligned solid inks adjacent to each other in said cartridge main body;

a carrying device for carrying the stored ink cartridges either one or several at a time to thereby move said ink cartridge to a supply position at which the solid inks retained by said carried ink cartridge are to be supplied to said heating device; and a supplying device for supplying the solid inks retained by said carried ink cartridge at the supply position to said heating device either one or several at a time.

6. An ink supplying apparatus according to claim 5, wherein said storing device piles up and stores said ink cartridges, and said carrying device carries said piled and stored ink cartridges to the supplying position, one by one, in an order starting from a bottom thereof.

7. An ink supplying apparatus according to claim 6, wherein said carrying device comprises a roller device for carrying, in accordance with a rotation thereof, said ink cartridge stored at a lowest portion in said storing device to the supply position.

8. An ink supplying apparatus according to claim 6, wherein said carrying device comprises a belt conveyer device including a belt and a moving section for moving said belt so as to carry said ink cartridge stored at a lowest portion in said storing device to the supply position.

9. An ink supplying apparatus according to claim 6, wherein said carrying device carries said ink cartridge stored at a lowest portion in said storing device to the supply position by pushing a rear end of said ink cartridge in a carrying direction thereof.

10. An ink supplying apparatus according to claim 6, wherein said ink cartridge retains the solid inks aligned in one line along a carrying direction of said ink cartridge, and said supplying device supplies the solid inks retained by said carried ink cartridge to said heating device, one by one.

11. A printer comprising:

an ink supplying apparatus for supplying a plurality of solid inks;

a heating device for heating and dissolving each of the supplied solid inks; and a recording device for recording record information by use of the dissolved ink, said ink supplying apparatus comprising:

a storing device for storing a plurality of ink cartridges, each comprising a cartridge main body in which the solid inks are aligned and retained, and a plurality of gap members disposed in said cartridge main body for prescribing a gap between each pair of the aligned solid inks adjacent to each other in said cartridge main body;

a carrying device for carrying the stored ink cartridges either one or several at a time to thereby move said ink cartridge to a supply position at which the solid inks retained by said carried ink cartridge are to be supplied to said heating device; and a supplying device for supplying the solid inks retained by said carried ink cartridge at the supply position to said heating device either one or several at a time.

12. A printer according to claim 11, wherein said recording device records the record information by means of an ink jet method.

* * * * *